US005624050A

United States Patent [19]

Haas

[11] Patent Number: 5,624,050

[45] Date of Patent: *Apr. 29, 1997

[54] LID AND STRUCTURAL ARRANGEMENT FOR RECYCLING AND REFUSE RECEPTACLES

[76] Inventor: Philip C. Haas, R.D. #2 Box 159, Kempton, Pa. 18529

[ * ] Notice: The portion of the term of this patent subsequent to Oct. 7, 2012, has been disclaimed.

[21] Appl. No.: 105,905

[22] Filed: Sep. 1, 1993

Related U.S. Application Data

[63] Continuation-in-part of Ser. No. 857,379, Mar. 25, 1992.

[51] Int. Cl.[6] ..... B65F 1/16; B65D 8/00

[52] U.S. Cl. ..... 220/4.05; 220/4.11; 220/401; 220/909

[58] Field of Search ..... 217/76, 51, 88, 217/90, 91, 106; 220/4.11, 4.04, 4.05, 908, 909, 401, 319

[56] References Cited

U.S. PATENT DOCUMENTS

| | | | |
|---|---|---|---|
| 1,087,138 | 2/1914 | Robinson | 217/51 |
| 1,237,016 | 8/1917 | Brown | 220/908 X |
| 2,031,153 | 2/1936 | Fessenden | 217/76 |

*Primary Examiner*—Allan N. Shoap
*Assistant Examiner*—Nathan Newhouse
*Attorney, Agent, or Firm*—Charles A. Wilkinson

[57] ABSTRACT

The outside of the structural reinforcing rings are slightly inclined inwardly or outwardly with respect to the vertical axis of a slatted refuse or recycling receptacle to provide a pleasing bow inwardly or outwardly to the outward surface of the receptacle when the slats are pulled tightly against the slightly inclined surfaces. In addition, the lid for such containers may be provided with a very visible designation of the type of refuse or recycling materials to be inserted into dual orifices in said lid.

13 Claims, 8 Drawing Sheets

FIG. 27
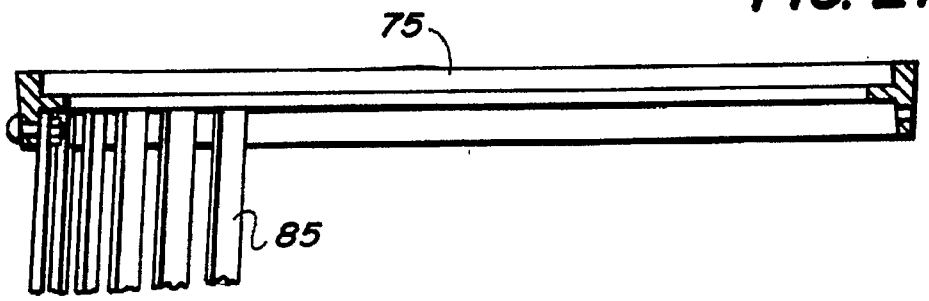
FIG. 29
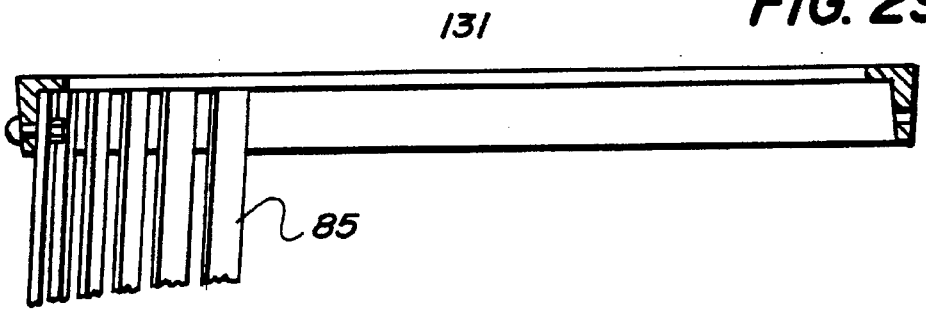
FIG. 28
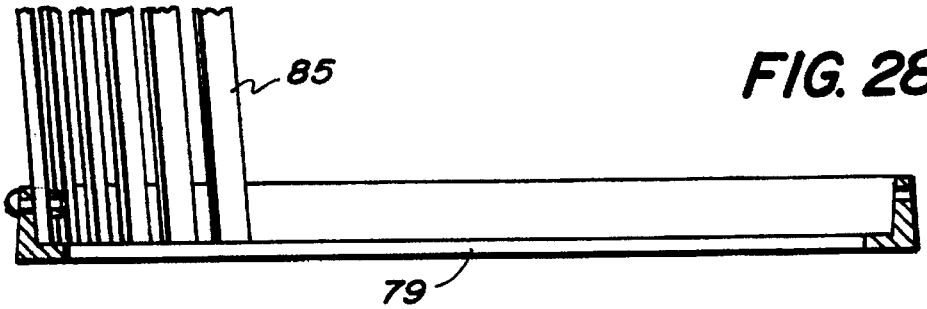
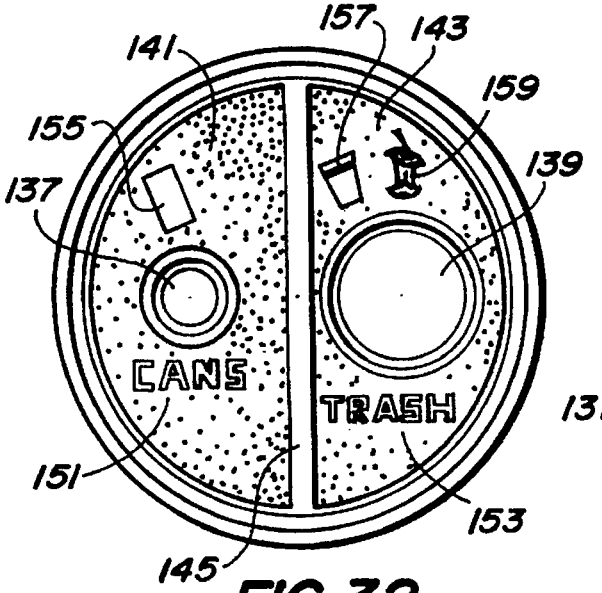
FIG. 32
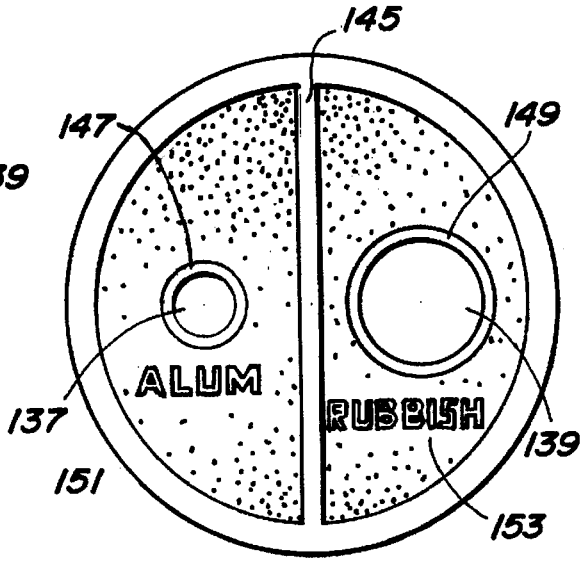
FIG. 33

LID AND STRUCTURAL ARRANGEMENT FOR RECYCLING AND REFUSE RECEPTACLES

RELATED APPLICATIONS

This application is a continuation-in-part of application Ser. No. 07/857,379 filed Mar. 25, 1992 entitled "Improved Lid and Structural Arrangement".

BACKGROUND OF THE INVENTION (1) Field of the Invention

This invention relates broadly to the collection of recyclables and refuse and more particularly to the provision of durable tamper-proof public receptacles for recyclables and refuse. More particularly still, the present invention relates to an improved tamper resistant closure or lid for public receptacles as well as an improved structural arrangement for strengthening such receptacles when they are provided with a slatted exterior plus an improved arrangement for marking the tops of such containers to aid in directing the public how best to use such receptacles.

(2) Description of the Prior Art

During the last two or more decades the public collection of recyclables such as particularly cans of various compositions, glass bottles, plastics, paper products and other nominal waste materials and particularly waste packaging materials which can be recycled has come more and more to the fore. Public bodies such as municipalities, state and federal parks and other public bodies as well as corporate entities such as large companies and the like have undertaken to provide recycling and refuse receivers in public places to encourage the public to both dispose of their refuse and to aid in the collection of recyclables for further processing.

At one time the common public container for all kinds of waste materials was the ubiquitous heavy wire-mesh container. Such containers were fairly durable due to their heavy construction plus a certain degree of resiliency or bendability conferred by the open mesh wire construction. Such containers, however, have the disadvantage that the contents are exposed to public view and are frequently objectionable to many members of the public. In more recent years various solid containers such as, in many cases, concrete containers and the like have been substituted for the former wire-mesh containers, although wire-mesh containers are still used, particularly where aesthetics is not a factor. While such concrete and the like containers are fairly durable and in many cases, particularly when they have an exterior surface of small decorative stones or the like, not unattractive, they are in many cases both difficult to empty and also expensive. Generally solid containers made of thin coated metal or even durable plastic, including heavy plastic materials, are fairly economical and easy to handle, but objectionable to many people simply because they look like "garbage cans". They are also often subject to vandalism, since they can be easily picked up, knocked over and otherwise mishandled, in which case the metal tends to bend and flake off its coating, after which it becomes subject to corrosion. Plastic containers, in addition, can usually be fairly easily cracked or otherwise damaged when attacked by a determined vandal.

Within the last twenty years, a type of container having a decorative exterior composed originally of wood slats to give it a rustic appearance and more recently of plastic slats which look like wood or similar materials have come into use, particularly in upscale locations such as in shopping centers, public parks, the interior of large buildings and other places where it is desired to have a trash or recycling receptacle in plain sight, but the appearance of an ordinary trash receptacle or garbage can may be unacceptable. The provision of vertical wooden slats or artificial material slats having the appearance of wood over a cylindrical receptacle is particularly desirable because of the rustic appearance provided plus the ease of applying a vertical slat to the exterior of a cylindrical container, so long as the slat is maintained longitudinally aligned with the length of the cylinder. As indicated above, such receptacles have been in use for about two decades and have been extremely popular for about a decade. Such receptacles have been made in various ways including the attachment of the rustic slats on the outside of an ordinary trash can or barrel as well as the provision of a cylindrical shaped receptacle by the use of various internal supporting means such as structural rings and the like to reinforce the outer slats so that the combination of the slats and the rings forms their own receptacle. If adequately reinforced internally, such slated exterior ring-reinforced-type containers have proved reasonably strong and durable.

Within the last several years a new type of container or receptacle having a slated exterior has come into use. This type of container or receptacle is provided with a slanted top rather than a flat top resulting in a particularly attractive design. Furthermore, when such slatted receptacles are arranged around a central unifying post, a particularly attractive and aesthetically pleasing arrangement is provided. Such an arrangement is disclosed in U.S. Design Patent Des. 331,824 issued Dec. 15, 1992. The initial construction of the new slanted top slatted receptacles was effected by fastening slats with threaded fasteners to the exterior of an ordinary steel barrel with the fastenings passing into the external barrel hoops on such barrel. The internal steel barrel formed a strong construction for the container itself and the slatted exterior with attached differential length slats provided a pleasing appearance to the exterior. When a lid was desired, a flat lid was merely placed in the top supported by internal tabs spaced, usually at four locations, on the interior of the slats. The top could either be supported in a horizontal position or preferably was slanted to conform more or less with the top of the receptacle. Unfortunately, while the described arrangement provided a strong lower section to the receptacle, the upper slanted portion was left essentially unsupported, particularly with respect to the longer or higher slats and there was, furthermore, no satisfactory way to securely attach the top to the receptacle.

Consequently, while the slanted top-slatted recycling and refuse receptacles referred to above have become extremely popular, their configuration has resulted in several difficulties. One of these difficulties is that while an ordinary slatted-flat topped configuration is fairly easy to reinforce near the top by internal rings or other means, when the top is slanted, the longer slats on one side are difficult to reinforce and may, if attacked by a particularly determined vandal, become rather easily damaged.

A somewhat related difficulty has been that in these increasingly vandalism and scavenger prone times, certain uninhibited persons may rather frequently attempt to remove recyclable materials from the receptacles and also to strew any refuse about the surrounding environment. While, as explained above, tops have been used on the slanted top receptacles, it has been difficult to secure said tops to the receptacle itself or to close off the top to limit access to the interior thereof, because of the arrangement with relatively short slats on one side and relatively long slats on the other side and because the top is desirably arranged also in a slanted position.

Any top or lid, therefore, has usually been merely set into the top and supported upon tabs or knobs and the like extending from the inside of the slats. In other cases, the top, which usually has a hole in the center or close to the center, is secured directly by a screw fastening or the like through short tabs or peripheral flanges to the outer slats. The disadvantage of this, however, is not only that the arrangement is inherently weak, but the top then cannot be easily released in order to empty the receptacle.

Quite frequently these receptacles will have a plastic bag-type liner in them which actually receives the recyclables or the refuse. They also may be provided with a solid plastic container inside the slatted receptacle in order to receive the recyclables or the refuse. In both cases, however, it is impossible to easily empty the contents by removing either the flexible bag-type plastic container or a solid cylindrical receptacle, unless the top is completely removed or else swung largely out of the way on a hinged arrangement or the like.

The construction of the top of the receptacles with differentially elevated slats at different points around the circumference for aesthetic considerations does not easily lend itself to the provision of either a strong top or a conveniently openable top. If a top is merely laid in upon some sort of supports within the interior of the slatted receptacle, it may be easily removed for emptying the receptacle, but may be just as easily removed by vandals or scavengers.

There has been a need therefore for a strong, durable and conveniently openable and securable lid or top for slanted type slatted receptacles used in upscale public locations as well as for a stronger structural arrangement for the upper portion of a slanted top-slatted receptacle. There has been a need, furthermore, for such stronger construction to not interfere with and, if possible, to improve the aesthetics of such slanted top-slatted receptacles.

The previous slatted-type refuse and recycling containers and receptacles have also been supplied with essentially straight slats, particularly when secured directly to the surface of an underlying barrel or other heavy support. However, it has been found to be advantageous to have a slight inward or outward bow in the slats to provide the sides of the receptacle with almost a subliminal air of lightness. This feel of lightness or perception of lightness has been found to be very desirable from a design standpoint and as pointed out in the Applicant's previous application, it has been found that such minor bowing of the slats can be conveniently accomplished by fastening the slats, usually with threaded fastenings, securely to an internal support ring having a slight slant and sufficient structural strength not to be distorted itself by the stress imparted to the slats drawing them tightly against the surface of the slanted ring. In Applicant's previous application, the oval ring at the top, as well as a round ring at the bottom, supplied a slightly inwardly slanted surface against which the ends of the slats could be tightly drawn.

It has also been found that when two orifices are used in the top of a container or receptacle for insertion of different types of refuse or recyclables, that it is very difficult to provide clear instructions to the public for the proper materials to be inserted into such orifices. Not only is it difficult to provide a message or instructions which are clear and explicit to everyone, and particularly to those who are giving the matter less than full attention, but any such message provided is invariably painted on, in which case the message quickly fades or is obliterated by time and abrasion of the users' hands, the hands of those removing the top to empty the receptacle and the like.

OBJECTS OF THE INVENTION

It is the object of the present invention therefore to provide a strong durable top upon a slanted top-slatted receptacle for recyclables or refuse.

It is a still further object of the invention to provide a top combination which not only effectively closes off the receptacle in a pilfer-proof manner, but also substantially strengthens the top of the receptacle to prevent breakage or other damage due to vandalism or other causes.

It is a still further object of the invention to provide a strong durable top which is substantially damage resistant.

It is a still further object of the invention to provide a removable lid or top for a slanted top-slatted receptacle which is easy to make and economical in manufacture.

It is a still further object of the invention to provide a slatted receptacle construction which is conveniently and effectively given a slight curved configuration along the central section which increased the attractiveness.

It is a still further object of the invention to provide designation material upon the surface of the top for the invention which is effective to designate the users of a dual opening top the proper use of each opening.

It is a still further object of the invention to provide a receptacle for recyclables and refuse which is considerably sturdier at the top than previously available receptacles.

It is a still further object of this invention to provide a slanted top-slatted receptacle having a strengthened, more pleasing external configuration.

It is a still further object of this invention to provide an arrangement whereby the structure of a slatted-type receptacle is substantially stiffened internally near the top.

It is a still further object of the invention to provide a securely closed slatted-top slanted top receptacle which is both economical and attractive.

It is a still further object of the invention to provide a flat topped slotted receptacle having a slight bow either inward or outward to the slats by the use of a tapered section on an internal support ring.

It is a still further object of the invention to provide a durable damage-and wear-resistant instructions for the top of a slatted receptacle or receptacles in general.

Other objects and advantages of the invention will become evident from a study of the following description and appended drawings.

BRIEF DESCRIPTION OF THE INVENTION

This invention is directed to the provision of a lid or top arrangement or assembly for a refuse and recycling receptacle comprised of a series of slats arranged adjacent to each other in a circle to form a cylindrical container and having either differential lengths arranged so that the top of the container is slanted or similar lengths so the top of the container is flat. The top assembly for such receptacles includes an outer structural ring formed either in a somewhat oval or elliptical shape, referred to herein as an ovoid configuration, and having an outer angled curvature which matches with the inside configuration of the top of a slanted top container or alternatively having a round configuration matching a flat top container. The outside of the structural ring for a slanted top container is slanted outwardly from the top to the bottom on one side, slanted inwardly from the top to the bottom on the opposite side and configured to be substantially vertical at positions approximately ninety degrees from the slanted out and slanted in positions, the intermediate portions of the outer sides of the ring incorporating or having progressive changes in the slant of the outer surface of such ring to conform to the inner configuration of a receptacle. In the case of a flat top container, the round ring slants slightly at all points where a slight taper is to be established in the sides or slats of the receptacle. The structural ring has preferably a "T" section with the outer end or top or cross portion of the "T" forming the outer continuously changing differential slanted portion of the structural ring and the web of the "T" forming an inwardly extending seat for the bottom of the lid or top which may be locked to the seat by outwardly extending tabs. The outer lower portion of the "T" has a series of holes around the perimeter for the receipt of fastenings which serve to hold the slats of the receptacle flat against the outside of the "T". The top or lid of the top assembly is preferably made as an upwardly curved outer section having a flat section around the outer rim which lies flat against the web of the "T" forming the outer ring. Alternatively, the lid itself can be flat. The outer ring is slightly elliptical or oval in order to better conform with the shape of the inner portion of the receptacle when the ring is angled into position. The lid or top is also preferably slightly elliptical or oval in order to conform with the oval shape of the structural ring. However, a less preferred form of the top could be substantially round with the web of the "T" of the outer structural ring extended to make up the difference where the ring would have greater dimensions in one direction than in the perpendicular direction.

Preferably, the outer cross T section of the outer upper ring has a generally decreasing cross section from top to bottom and there is a lower or bottom ring which has a generally decreasing cross section from bottom to top resulting in a slightly slanted outer surface which, when plastic slats are brought closely against the outer edges of the two structural rings, leads to a pleasing bowed or slightly hourglass-shaped outer configuration of the receptacle. In the case of a flat-topped container, the elliptical support ring is replaced with a round support ring usually in the shape of an "L" with a tapered leg but may also comprise a "T" section in which a crosspiece is tapered from one end to the other. Whether the bow provided in the slats is therefore either an inward bow or an outward bow will depend whether the slats are bolted or otherwise securely fastened to the tapered crosspiece on the inside or the outside of the tapered portion. If fastened on the outside, the bow will be inwardly while if bolted on the inside, the bow will be outwardly.

The orifice in the lid is preferably provided toward one side of the lid and surrounded by a depression in the top of the lid. The lock is then preferably placed at the top of the lid. However, the exact arrangement of the opening, depression and lock on the surface of the lid together with the curvature of the lid are primarily ornamental design features which may be changed without effecting the function or utility. For example, the top may be flat, the opening in the lid may be provided in the center and the lock may be provided on the same side as the orifice in the lid. In addition, the opening can be made much larger or can be divided into two separate openings.

In the case of two separate openings in the lid, which are invariably placed in the lid or top of the receptacle in order to attain the ability to insert different types of materials into separate compartments in one receptacle, it has been a problem in the past to adequately designate the types of materials which should be inserted through such two orifices. Consequently, as a part of the present invention it has been provided that such designation be made in a particular manner, namely that each of the orifices be surrounded by a plastic template in which are cut outlines of words such as "CANS" and "TRASH" adjacent to the orifices on one side and incorporating pictures or symbolizations of the intended contents on another side of such orifices. In addition, the two separate cutouts are preferably made from significantly different colored templates to emphasize their difference and will have a dividing line of a different color still which will usually be the surface of the cover itself extending between them to further emphasize the separateness of the two sides and the orifices leading into the receptacle on the two sides. The separate compartments into which the two orifices lead may be desirably formed from separate flexible plastic bags suspended in the two sides, of the receptacles but may also comprise solid plastic or other material liners.

BRIEF DESCRIPTION OF THE DRAWINGS

FIG. 27 is a partially broken-away sectional view of slats attached to the inside of an upper ring in accordance with a further embodiment of the invention.

FIG. 28 is a partially broken-away sectional view of slats attached to the inside of a lower ring in accordance with a further embodiment of the invention.

FIG. 29 is a partially broken-away sectional view of slats attached to the inside of an L-shaped ring at the top of a slatted receptacle in accordance with a further embodiment of the invention.

FIG. 32 is a plan view of a preferred lid of the invention similar to FIG. 22 showing two orifices, one of which, however, is smaller than the other in keeping with its use for accepting just cans and particularly soft drink cans in public places and incorporating about said orifices on the surface of said lid a template-type designation system in accordance with the invention formed from two separate plastic sheet materials having contrasting colors to distinguish said orifices in accordance with the invention with respect to use.

FIG. 33 is a plan view of a further preferred lid of the invention in the form of a flat lid for use on one of the receptacles of the invention incorporating a template designation system.

DESCRIPTION OF THE PREFERRED EMBODIMENTS

The present invention provides a novel structure for a lid assembly for use on a slanted top slatted recycling and refuse receptacle to provide security against scavenging as well as considerably strengthening the top section of the slatted receptacle. The combination of the new top and structural ring supporting the top upon a slatted top receptacle provides a substantially stronger, more vandal-resistant construction in an economical and convenient manner. It is a common problem in this day and age with publicly exposed equipment such as park benches, tables, light standards and particularly refuse containers and the like to have significant vandalism committed against such equipment.

The present invention also provides further arrangements of tapered support rings and attached plastic composition slats providing for slight inward and outward bows to the slats depending on the combination of the slats with the rings to attain a more pleasing aspect to the outline of the receptacles while attaining a very strong vandal-proof construction. The receptacle can have either a slanted-type top or a flat top.

The top of a two or multiple holed lid for a receptacle such as a combined trash and recycling receptacle is also provided in a further aspect of the invention with a multiple template arrangement incorporating contrasting colors and having both spoken language and sign-type language to indicate what the differential orifices are to be used for.

Figure 1:
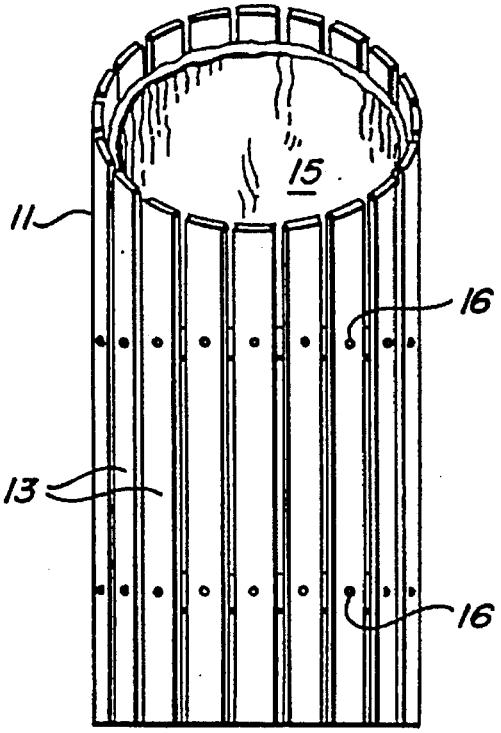
FIG. 1 PRIOR ART
FIG. 1 is a side elevation of a slatted-type slanted top receptacle as constructed prior to the present invention.
Figure 22:
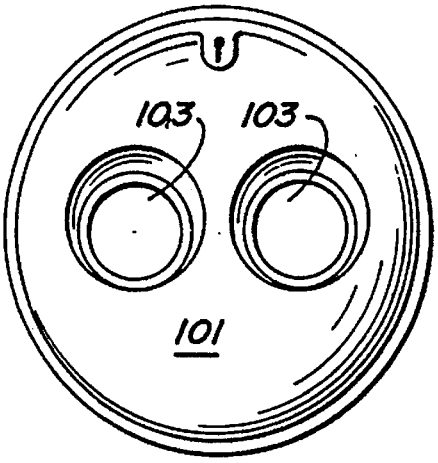
FIG. 22 is a plan view of the top of the invention showing two side-by-side orifices in the top.
Figure 23:
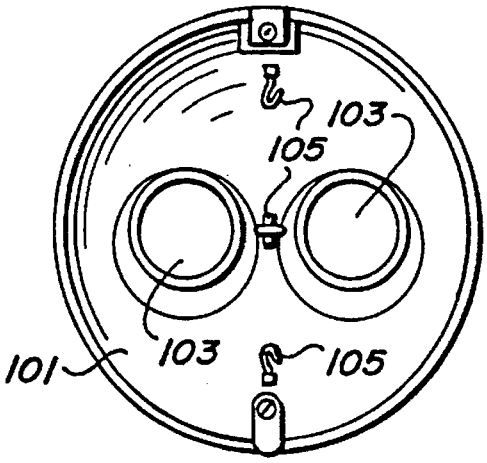
FIG. 23 is a bottom view of the top or lid shown in FIG. 22 showing a row of hooks in the top to which plastic bag-type internal receptacles may be attached.

Referring more particularly to the appended figures, FIG. 1 shows a prior art slanted top slatted receptacle 11 comprised, on its outer circumference at least, of a series of adjacent slats 13 formed from a plastic composition having the general appearance of wood in some cases or other neutral colors or materials in other cases. Preferably such plastic resin slats are made from recycled plastic resin material. In FIG. 1 there is shown within the interior of the receptacle 11 a plastic resin bag-type container which actually receives the recyclables or refuse deposited within the slatted-type-slanted top receptacle. It will be understood that as an alternative, a solid interior receptacle could also be used to actually collect the materials deposited within the receptacle 11. As illustrated in FIGS. 22 and 23, several interior flexible receptacles such as plastic bags attached to the holes shown in FIG. 23 could be used.

Figure 2:
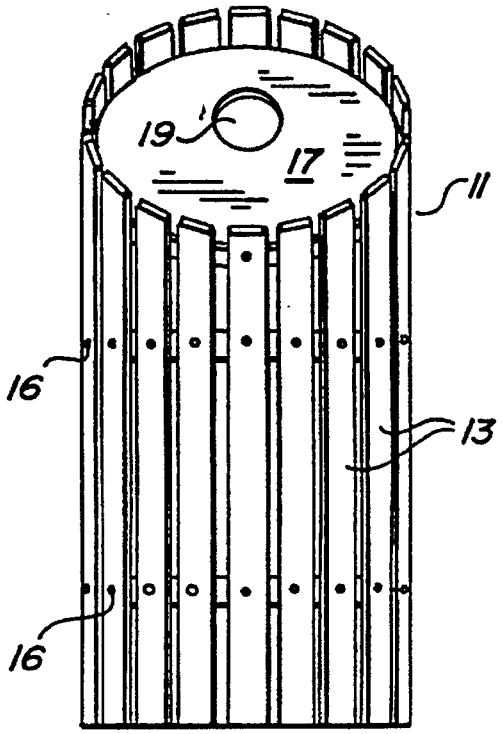
FIG. 2 PRIOR ART
FIG. 2 is a further view of the slatted-type slanted top receptacle of the prior art with a widely used lid or covering provided in the top of the receptacle.

FIG. 2 shows the same slatted-type slanted top receptacle of the prior art as shown in FIG. 1, but having in this case, a solid top or lid resting within the upper portion of the receptacle 11. The lid 17 has a central orifice 19 through which recyclables and refuse can be inserted by the public. The top merely rests upon tabs or the like, not shown, extending from the interior surface of three or four of the slats.

Figure 3:
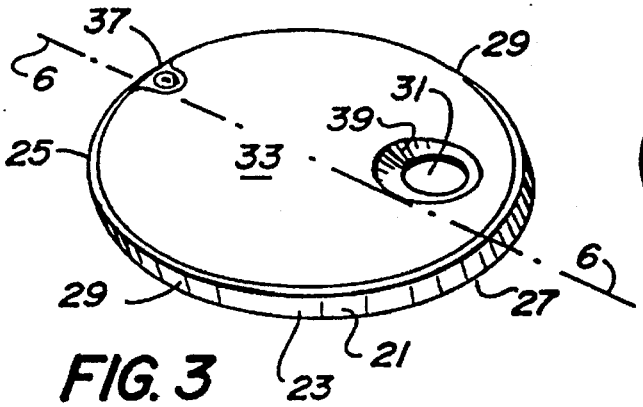
FIG. 3 is an isometric view of the combined top and structural ring of one embodiment of the present invention.

FIG. 3 is an isometric view of the outside configuration of the structural ring and lid assembly of one embodiment of the invention in which an outer structural ring 21 has an outer surface 23 which continuously changes its orientation from one portion of the outer surface to another and having an inward slant from top to bottom at the upper portion 25 and an outward slant from top to bottom at a lower portion 27 of the ring. The two central portions 29 of the outer structural ring 21 have essentially a vertical configuration or no slant. The designations "upper" and "lower" and "central" portions in this connection refer to the inclination of the structural ring and lid combination when positioned in the top of a slanted top-slatted receptacle. The noted differentially varying slant or angle of the outer surface 23 of the outer structural ring 21 is angled such that when the structural ring and lid are inserted within the top of the slatted receptacle at approximately the same angle as the angle of slant of the top, the outer surfaces of the ring will all be exactly vertical or, alternatively, the same as the angle of the slats referred to true vertical and the slats will lie flat against said outer surfaces 23. In the usual construction, the sides of the ring will be oriented in a vertical direction when the structural ring 21 is placed within the slatted receptacle having vertically configured slats.

An orifice 31 is provided in the lower portion of the top or lid 33 and the bottom outer edges of the lid 33 are engaged with a top surface or seat 45 on an inner flange 43 parallel with the upper surface of the structural ring 21. See, in particular, FIG. 4. A locking mechanism 37 is provided, preferably near the upper portion of the lid. A depression 39 in the top 33 may surround the orifice 31 in the top 33.

Figure 4:
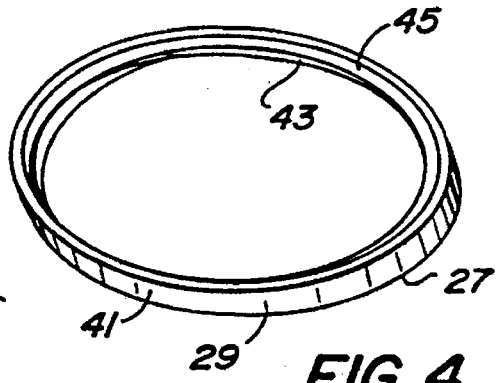
FIG. 4 is an isometric view of the structural ring of one embodiment of the present invention by itself.
Figure 5:
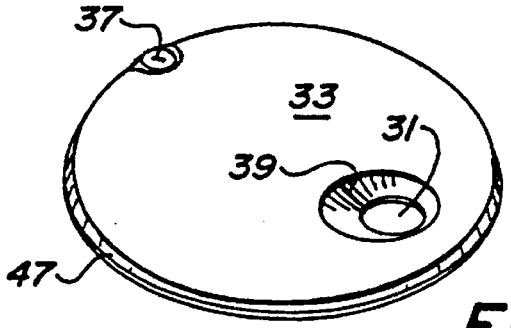
FIG. 5 is an isometric view of the lid of the present invention by itself.
Figure 6:
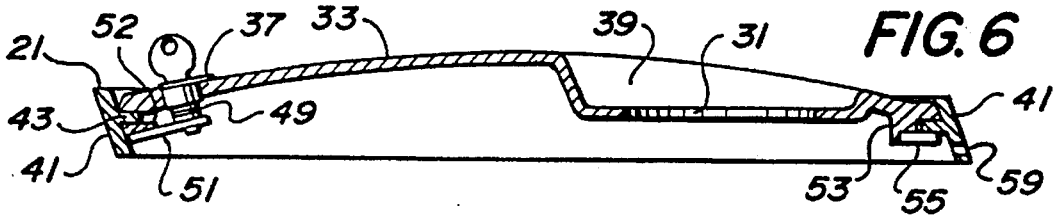
FIG. 6 is a cross section of the combined lid and structural ring as shown in FIG. 3 showing how the lid fits into the ring.

As seen in FIG. 4 and also in FIG. 6, which is a cross section along line 6 in FIG. 3, the outer structural ring 21 has preferably a basic T-section with the "T" understood to be lying on its side with the outside of the crosspiece 41 forming the outer surface of the structural ring 21 and having, as explained above, a continuously changing angle upon its outer surface matching the angle of the adjacent more or less vertically arranged plastic slats of the receptacle 11. The central web 43, or leg of the "T", in the meantime extends inwardly and is tilted overall at the same angle as the structural ring itself which, as indicated above, is angled at approximately the same angle as the top of the slanted topped receptacle. The upper portion or surface 45, as best shown in cross section in FIG. 6, serves as a seat for the outer sides 47 of the lid 33. As seen best in FIG. 6, the locking means 37 has a pedestal or lock extension 49 extending from the lock 37 downwardly and at the lower end, has a metal crosspiece 51 which, when the pedestal or an internal portion of the pedestal is turned by the locking device 37 may pivot to contact the underside of an extension or raised portion 52 of the leg or web of the "T" 43, effectively locking that side of the top or lid 33 to the outer structural ring 21, or more particularly to the extension 52 of the leg or web 43 of the outer structural ring 21. Likewise, at the opposite side of the top 33, there extends from the inside of the top, a second pedestal 53 having a cross piece 55 permanently secured to it, the end of which also engages the bottom of the leg or web 43 of the T-section of the outer structural ring 21 and therefore secures that side of the lid 33 to the structural ring. As indicated above, it will be recognized that the relative locations of the locking device, i.e. the rotatable pedestal or portion of the pedestal 49 and the stationary pedestal 53 can be reversed so that the lock is on the lower portion of the lid or even on the side of the lid. The location of the lock is primarily a matter of balance and design so that the outside of the lid has a pleasing ornamental appearance to the onlooker. It will be understood, of course, that the pedestal 49 and the pedestal 53 must always be approximately opposite each other in order to effect satisfactory locking of the lid or top to the structural ring 21. It will also be understood that while it is preferred to use the stationary pedestal 53 and cross piece 55 secured thereto, these structures could be replaced by a sturdy hinge movably connecting the lid with that side of the structural ring 21.

Figure 7:
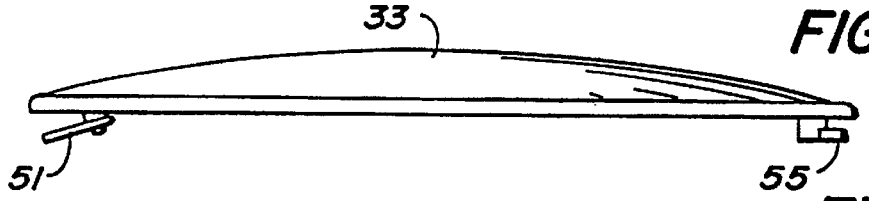
FIG. 7 is a side view of the preferred lid shown in FIG. 5.

FIG. 7 is a side view or elevational view of the top 33 showing the general convex curvature of the top which again is primarily a design feature from an artistic viewpoint as well as the crosspieces 51 and 55 of the locking means.

Figure 8:
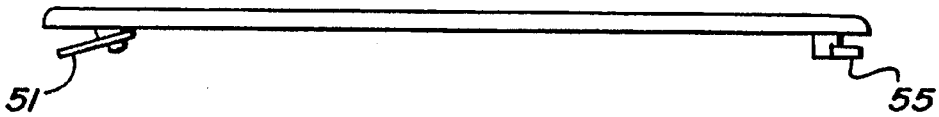
FIG. 8 is a side view of an alternative and less preferred form of the lid having a flat top.

FIG. 8 shows an alternative lid which has a substantially flat top. The lid is preferably a casting and there is little difference between the two lids in FIGS. 7 and 8 other than design features to provide a more pleasing combination with the receptacle.

Figure 9:
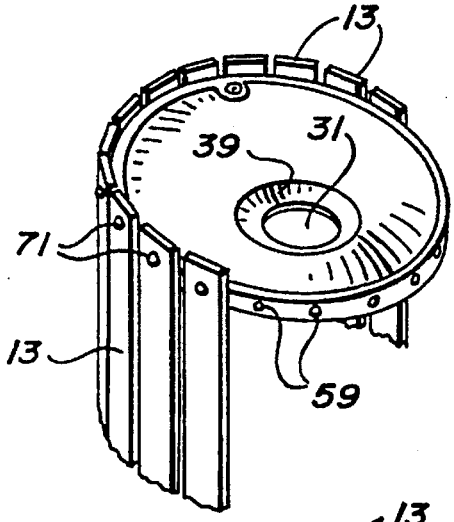
FIG. 9 is a partially broken away isometric view of the structural ring and lid of the invention mounted within the top of a slanted top-slatted receptacle showing the fastening orifices on the side of the structural ring for securing the slatted sides against the structural ring.

FIG. 9 is a partially cutaway isometric view of the combined structural ring 21 and lid 33 secured in the top of one of the slatted-type-slanted top receptacles. As shown in FIG. 9, the outer circumference of the lower portion of the crosspiece or head of the "T" 41 is provided with fastening orifices. In other words, the outer section of the structural ring 21 is provided with a series of orifices 59 which provide threaded fastening orifices for fastening the structural ring 21 to each one of the slats 13, which are likewise provided with an orifice to match the orifices in the ring 21. It should be noted that the orifices 59 are provided in the lower portion of the outer section 41 of the structural ring 21 below the flange 43 so that the fastenings do not interfere with the placement of the lid 33 upon the upper surface 45 or seat upon the inwardly protruding flange 43. As will be seen, when each one of the slats is attached to the structural ring 21, which is fairly close to the top of the slats and also positioned preferably an approximately equal distance from the top of each of the slats, a very rigid overall structural assembly is provided at the top. The lower portion of the structure of the slatted assembly is provided, preferably with at least one and in some cases two further rings which can take the form of fairly conventional flat barrel-type rings within the interior of the receptacle to which each of the slats is also attached by a screw fastening. Preferably, however, the lower ring 63 will take the form of an L-section with a lower flange on the bottom to increase the strength and, if desired, to provide a circumferential flange upon which a circular bottom section may be rested. Usually, any such bottom section will be merely loosely laid upon the lower leg of the L-section flange, since it need not provide any structural strength to the entire assembly. However, if it is desired to have a tight-fitting bottom, it will be preferable to use a T-section structural ring, as in the top of the receptacle, rather than an L-section. The L-section ring shown could also be reversed so that the flange is on the top.

As will be noted, when each of the slats is attached through screw fastening to each of the rings 21, 61 and 63, a very strong and essentially almost rigid structural section is provided. Such structural section is particularly strong at the top and the bottom where the structural rings 21 and 63 are located, since such rings and particularly ring 21 at the top have extra stiffness, provided by the interior flange 43 which serves as a seat for the lid 33. In fact, when one of the receptacles is to be used in a fairly protected environment where it is unlikely to be subjected to any untoward vandalism or exposed to any other potentially damaging impacts or shocks, the top lid or structural ring section may be secured to the slats of the slatted slanted top receptacle at only certain locations such as at the bottom, the top and both sides. However, as will be understood, since it is usually advantageous to have as strong a structure as possible, it is preferred to attach each of the slats 13 to the structural ring 21 by a suitable, threaded-type fastening or for that matter, any other suitable fastening. If this is done, it will in most cases not even be necessary to use the central reinforcing ring 61 shown in FIG. 10, except where an unusually rigid structure is desired.

Figure 12:
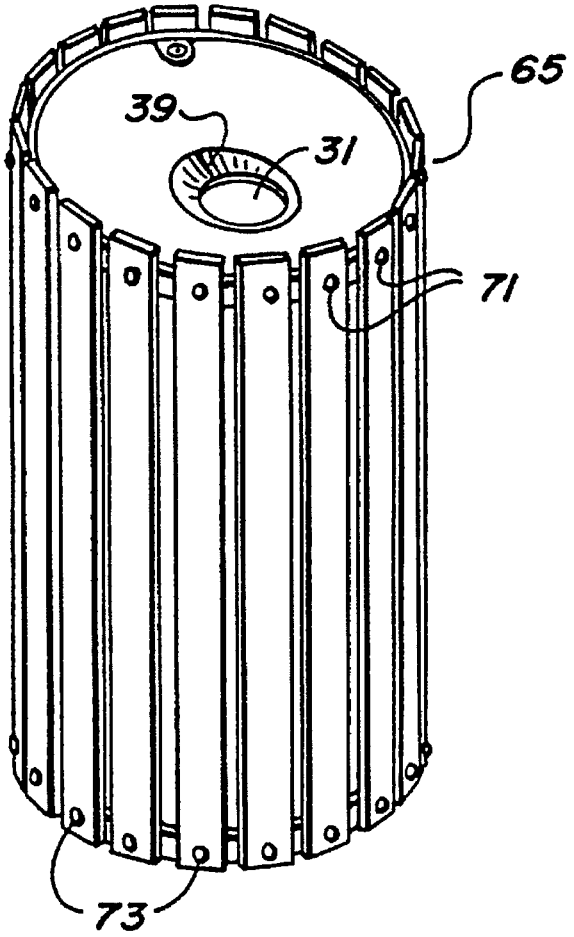
FIG. 12 is an isometric view of the overall combination of a slatted exterior-slanted top receptacle with the combined structural ring and lid or top of one embodiment of the invention.

FIG. 12 is a perspective view of the outside of the complete receptacle assembly in accordance with the invention, of a slatted slanted topped receptacle with the lid and structural ring combination of the invention attached thereto to form a receptacle 65 in accordance with the invention, which is both attractive and strong and durable as well as resistant to scavengers and vandalism.

Figure 13:
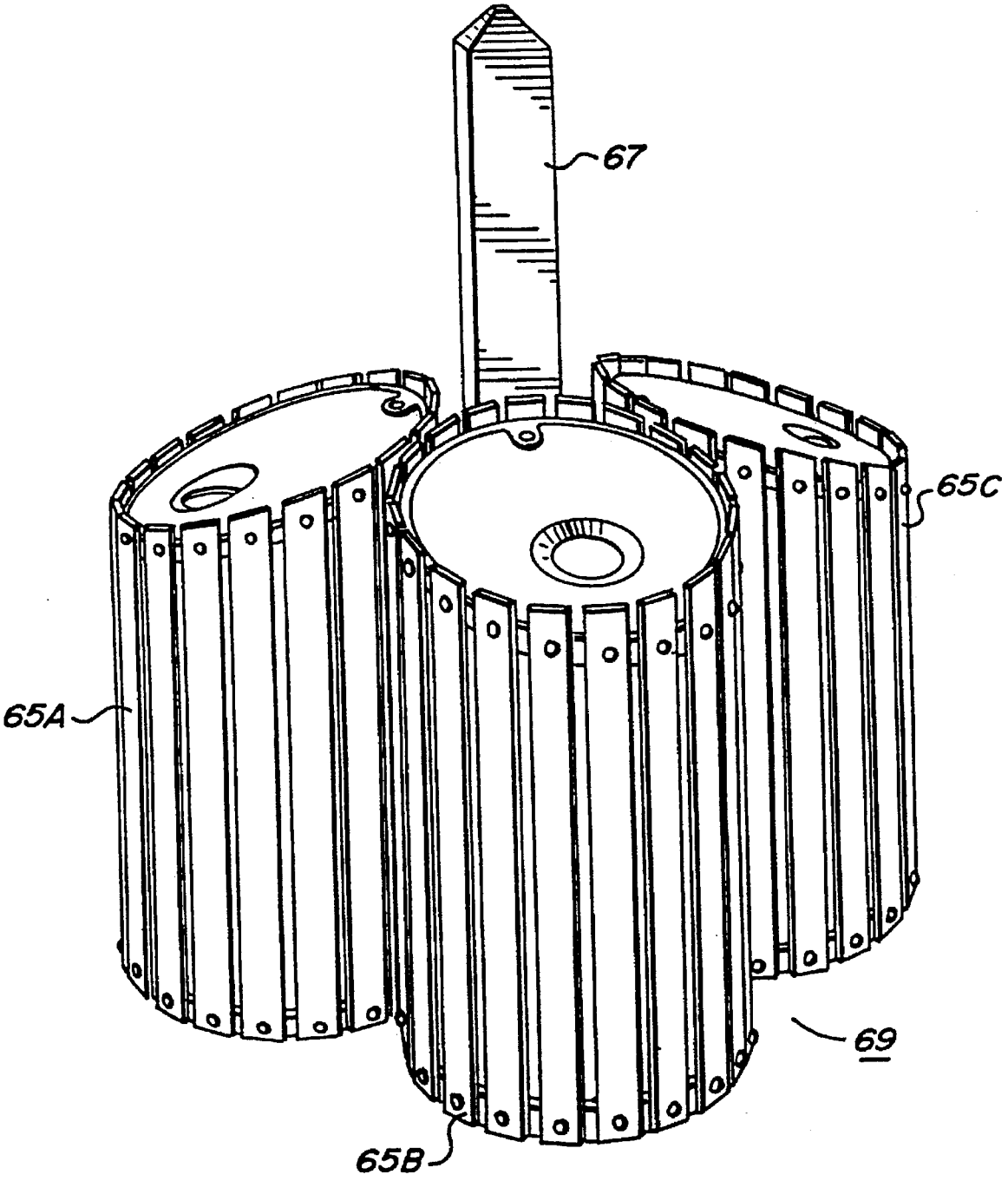
FIG. 13 shows a typical assemblage of several of the slanted top-slatted side receptacles as shown in FIG. 12 arranged around an aesthetically unifying post for use as a group of receptacles.

FIG. 13 shows several of the receptacles of the invention 65 designated as 65A, 65B and 65C surrounding and preferably attached to a central unifying post 67 to provide a multiple receptacle arrangement for the disposal of either different recyclables in each receptacle or to provide extra capacity for recyclables and refuse. The combined group of receptacles shown in FIG. 13 has been arbitrarily assigned a separate number 69.

Figure 14:
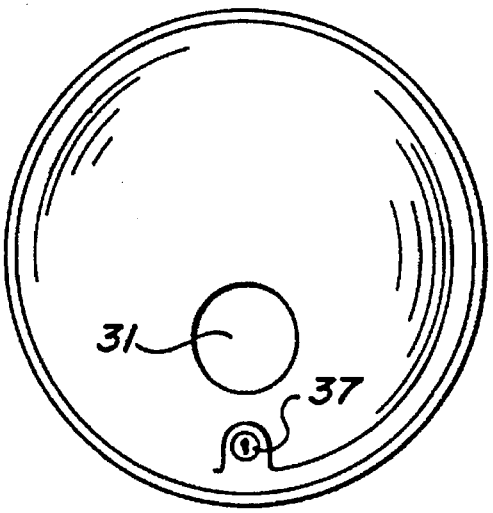
FIG. 14 is a plan view of an alternative embodiment of the invention in which the lock means and the orifice are located on the same side or bottom section of the lid.

FIG. 14 is a plan view of an alternative design for the top 33 in which the orifice 31 does not have a depression 39 around it as shown in the previous drawings or figures and also has the locking means 37 directly under the orifice 31 rather than at the top of the lid 33. Both the orifice and lock are therefore in the same quadrant of the lid rather than opposite quadrants.

Figure 15:
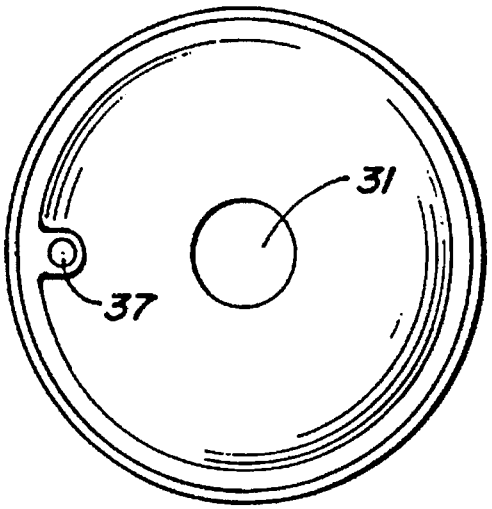
FIG. 15 is a plan view of a still further alternative embodiment of the invention showing the top of the lid wherein the orifice is provided in the center of the lid rather than in the lower portion and the lock is in the side.

FIG. 15 shows a still further embodiment of the invention in which the lid 33 has the orifice 31 directly in the center with the lock 37 at one side. There is also no depression around the orifice 31 in FIG. 15. It will be understood that in either FIGS. 14 or 15, the lid may have either an upward hemispherical section such as shown in FIG. 7 or a basically flat lid arrangement as in FIG. 8. The lock 37 could also be at the side of the construction shown in FIG. 14, although this would not be too desirable from an aesthetic or design viewpoint.

Figure 16:
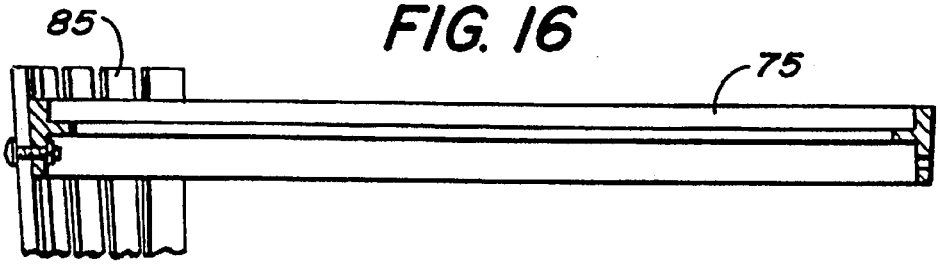
FIG. 16 is a partially broken away sectional view of a preferred structural ring of the invention in which the ring has a draft or decreasing side or cross section toward the bottom.

FIG. 16 is a partially broken away section taken through the top structural ring 75 of a preferred version of the invention showing a slight draft 77 or decreasing section in the ring in this case toward the bottom and from the outside of the ring 75. Such a draft or decreasing section 77 is frequently used to aid in releasing cast metal objects to allow easier separation from the mold without shattering the mold. The present inventors have discovered that if such a draft is provided upon the surface of the ring 75 and arranged correctly with a similar draft on the lower ring 79 of the receptacle, see FIG. 17, that a very pleasing and aesthetic configuration can be provided to the surface of the receptacle.

Figure 11:
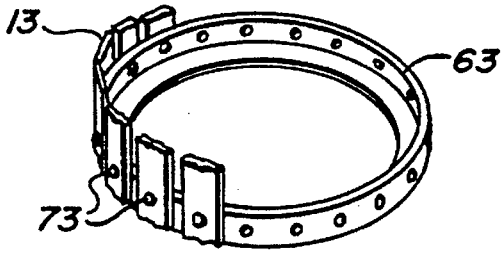
FIG. 11 is a partially broken away isometric view showing the bottom of the slatted receptacle shown in FIGS. 9 and 10 with a structural ring having the slats attached thereto.
Figure 17:
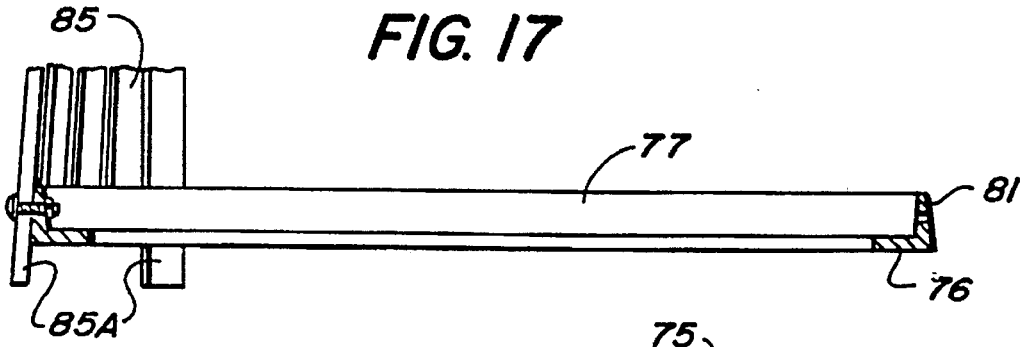
FIG. 17 is a partially broken away sectional view of the bottom ring of the invention showing a draft or decreasing side or cross section toward the top.

FIG. 17 is a similar view of the bottom ring 79 where it can be seen that such lower ring has an upwardly tapering draft 81 which also allows the bottom ring to be more easily cast from an aluminum alloy and removed from the mold. When used for the recycling and refuse receptacle of the invention, this arrangement with slight tapers or tapered sections 77 and 81 in the outside of the rings 75 and 79 when formed in opposite directions as shown in FIGS. 16 and 17 and when the outer slats on the slanted top-slatted receptacle are drawn in fairly tightly against the outer surfaces of the two rings, preferably by screw fastening means, the slats take a slightly inwardly bowed configuration, which, though slight, has a large effect upon the overall appearance. The slight bowing or hourglass appearance registers on the eye as a very pleasing lightness in the design giving a slightly airy or less bulky appearance. The slanted arrangement of the top structural ring with respect to the plastic slats, furthermore, prevents the spring tension in the slats from warping or springing the entire receptacle. As indicated in connection with FIG. 11, the bottom ring 77 shown in FIG. 17 could also be reversed to bring the flange to the top, in which event the taper or draft, particularly on the outside, would also be reversed so that it becomes inclined or bowed outwardly toward the top. If the flange 17 is, however, reversed and brought to the top of the receptacle to replace the ring 75, slats attached to the outside will still have an inwardly bowed configuration.

It will be understood that the draft, or slight inward inclination, of the outside of the top structural ring 75 will preferably be provided on all sides of the rings. Thus in FIG. 17, the slight inward slant of the side walls of the lower ring 77 will be understood to be the same on all sides, or preferably the same, since it need not be. It will likewise be understood that the top structural ring 75 will preferably have a similar slight inclination or draft at least on the outside in a downward direction on all sides. FIG. 16 shows such inclination only on the substantially vertical intermediate sides of the structural ring 75 where it is most visible or evident between the generally outwardly inclination lower outside front of the ring and the generally inwardly inclined upward top of the ring. However, it will be understood that the additional slight inward slant or draft of the external surface of the upper structural ring also preferably occurs on these surfaces. On the other hand, the pleasing hourglass shape of the slatted receptacle is perhaps most visible on the sides and to some extent, on the front of the receptacle in use so that the draft or slight inward inclination of the slats making up the outside walls of the receptacle is most important on the sides also from an overall aesthetics viewpoint. If the top ring 75 is made to fit horizontally in the top of the receptacle, it will preferably have an inward inclination all about the outside which will appear very much like, or, in fact, substantially identical to, that shown in FIG. 16 and the bow in the plastic slats will be essentially inwardly all about the receptacle.

As indicated above, previous slatted receptacles, including the slanted top-slatted receptacles of the present invention, were previously made by the present inventor using a central steel metal barrel as a central support for the outside slatted structure. However, when forming a slatted-type structure with internal structural rings, it is possible for one ring to rotate somewhat with respect to another ring or rings ultimately placing the slats in a slanted configuration which, while not really, per se, harmful, except for the excess stress placed upon the fastenings, does make the entire structure appear shoddy and defective. It has been found, however, that when using the shaped upper ring of the invention and placing it at an angle as shown to accommodate different heights in the outer slats to provide a slanted top configuration on the slatted receptacle, the slanted structural ring not only holds all of the slats firmly at the top, but also prevents the entire structure from twisting. It is effectively impossible for twisting to occur so long as the inclination of the structural ring is reasonably steep, since any twisting would result in either shortening or lengthening the point at which any given slat is secured to the structural ring 29 (in FIG. 12) or 75 (in FIG. 18) which shortening or lengthening is prevented by the resistance of adjoining slats to stretching or compression.

Figure 18:
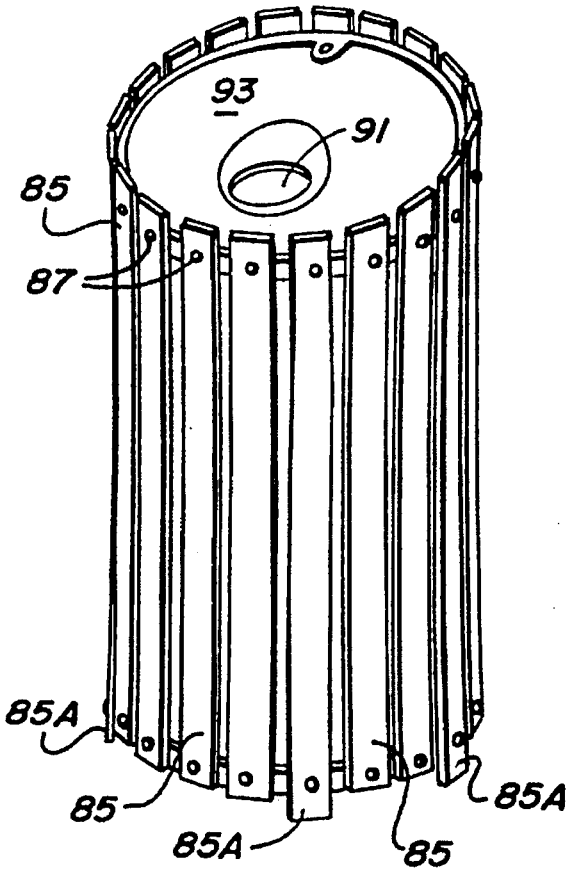
FIG. 18 is an isometric view of the overall combination of a slatted exterior-slanted top receptacle using the preferred structural rings of FIGS. 16 and 17 showing a slight inward bow or hourglass shape to the slatted sides of the receptacle plus short legs formed from lengthening some of the slats.

FIG. 18 is an isometric view of the preferred embodiment of a slanted top-slatted receptacle 83 of the invention showing a slightly hourglass shape of the outer slats 85 of the receptacle 83 as a result of being pulled tight against the structural rings of the invention having oppositely directed decreasing sections on the exterior of such structural rings which biases the upper and lower portions of the slats inwardly to provide a slight inward bowing of the slat structure. As indicated, the inclined disposition of the upper structural ring also braces the entire structure, particularly against any twisting and thus provides additional rigidity to the entire structure. Each of the structural rings is connected to the slanted structural ring by screw fastenings 87 extending through the slats 85 and the lower flange of the structural ring as shown in the previous figures. In FIG. 18 it will also be seen that every third or fourth plastic slat 85A is somewhat longer on the bottom. These slightly longer slats raise the receptacle structure from the ground or support surface and result in a slight appearance of the receptacle floating above such surface. This provides also a lighter more airy appearance, which increases the aesthetics of the receptacles, although it has no substantial effect on the strength or rigidity of the receptacle. In fact, the receptacle shown in FIG. 12 has additional support with the surface upon which it rests. However, such additional support is ordinarily not required. If desired, of course, additional support means, or legs, not shown, can be attached to the lower structural ring 77 preferably from the bottom of lower flange 76 of the lower structural ring 77.

Figure 19:
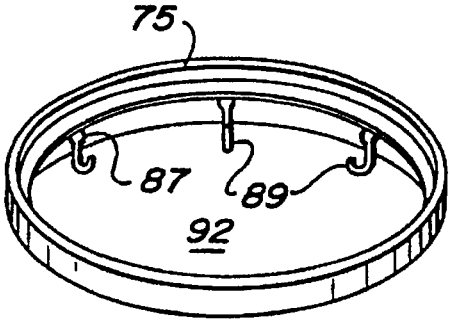
FIG. 19 is an isometric view looking into the top of the receptacle of the invention showing hooks mounted from the structural ring for supporting an internal bag.

FIG. 19 shows an isometric view of the inside of the top of the preferred structural ring 75 of the receptacle showing a series of hooks 89 attached to the interior ends of the screw fastenings 87 which secure the slats 85 to the lower flange 79 of the structural ring 75. The slats 85 are not shown in FIG. 19 except at the outside. These hooks 89 support the top of a heavy industrial grade plastic bag 92 which receives the material deposited into the receptacle through the opening 91 in the top or lid 93. When the bag is filled or partially filled, it may be easily removed from the receptacle after opening the top 93 and a new bag inserted. The hooks 89 could also be attached to the slats or other structure, but attachment to the lower flange of the upper structural ring is particularly effective.

Figure 10:
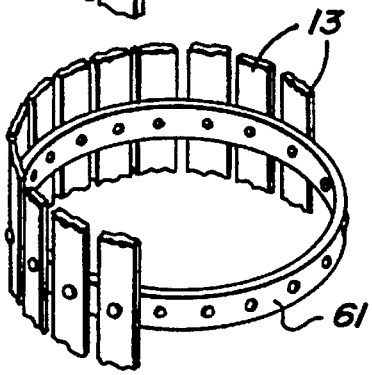
FIG. 10 is a partially broken away central sectional view of the same slatted receptacle as in FIG. 9 showing a structural ring within the interior of the slatted receptacle near the center of such receptacle to which structural ring the slats are connected.
Figure 20:
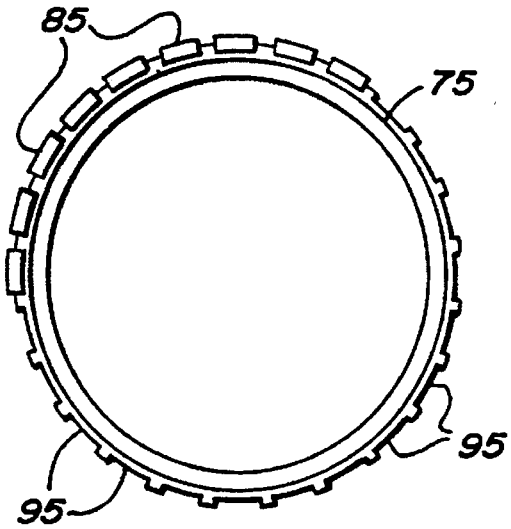
FIG. 20 is a view of the ring of the invention showing rectangular grooves in the face of the ring to receive and reinforce the slats.

FIG. 20 shows a further embodiment of the structural ring 75 of the invention having a series of rectangular recesses 95 in the surface into which the ends of the slats 85 may be received. The rectangular recesses or slots 95 further hold the slats 85 in vertical alignment with each other and form a particularly rigid structural arrangement. The same design arrangement may be used on the bottom structural ring 77. While the slotted arrangement is a preferred arrangement for rigidity and strength, it requires the fit between the outside dimensions of the slats and the inside dimensions of the slots to be fairly precise in order to add to the strength and rigidity, somewhat decreasing the ease of manufacture. Furthermore, as pointed out above, the slanted or inclined disposition of the top structural ring 75 in itself forms a very rigid, stable structure which in most instances is quite satisfactory without further reinforcement. The support slots 95 for the slats 85 may also be used on the lower ring 79 and/or on a central ring such as shown in FIG. 10.

Figure 21:
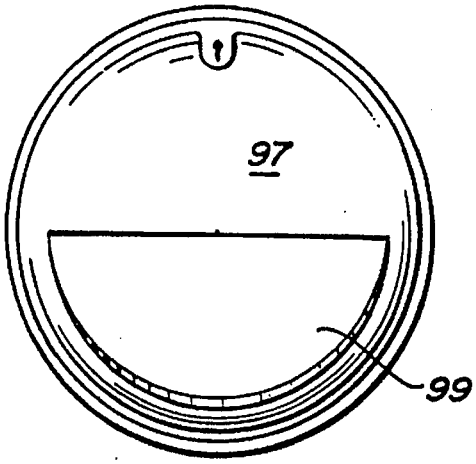
FIG. 21 is a plan view of the lid of the invention with a large semicircular orifice in the top.

FIG. 21 is a plan view of an alternative embodiment of a top 97 of the invention having one large semicircular opening 99 which has been found to be convenient in some circumstances.

FIG. 22 is a plan view of a still further alternative of a top 101 of the invention showing a pair of dual openings or orifices 103 in the top. If desired, these may lead into separate containers or bags disposed under the openings 103.

FIG. 23 shows the underside of the top or lid 101 showing the disposition of a row of hooks 105 in the center. Such row of hooks 105 or other securing means may be used when two plastic bags or the like are used under the dual orifices to receive materials disposed of into the two dual orifices 103. Each hook may be supported from a screw fastening means threaded into an opening in the bottom of the lid, preferably in restricted size pedestals projecting from the bottom. It will be understood that the remainder of the two plastic bag-type containers may be supported by similar hooks attached to the lower surface of the structural ring 75 as shown in FIG. 19. If desired, two rows of the hooks 105 may be used in the center of the lid, one for each bag. Of course, other types of dual containers such as solid plastic containers or the like may be used under the dual openings 103 as well.

Figure 24:
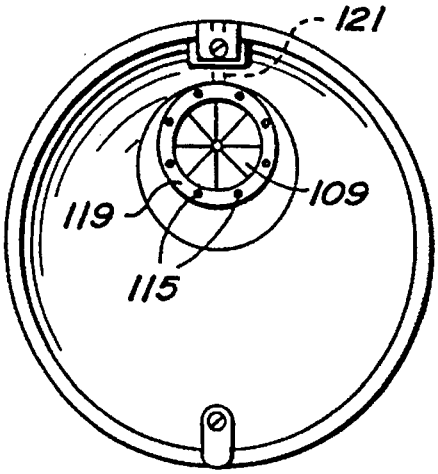
FIG. 24 is a bottom view of an embodiment of the invention showing a rain shield applied to the orifice.

FIG. 24 shows the underside of a top generally as shown in FIG. 23 with, however, a single orifice as shown in several of the previous figures with a further rain shield attached to the bottom of the orifice in the lid. The rain shield 109 is comprised of a flexible polymeric composition such as rubber or neoprene cut into a series of contiguous triangular closure sections 111 which are left attached to a surrounding ring 113 of the same material, which ring or outer section may be attached to the lip of the orifice 91. Preferably the ring is attached by screw fastenings 115 to the underside of the lip of the orifice as seen in FIG. 24. The screw fastenings may pass through small orifices 116 adjacent the base of the flexible triangular closures 111.

Figure 25:
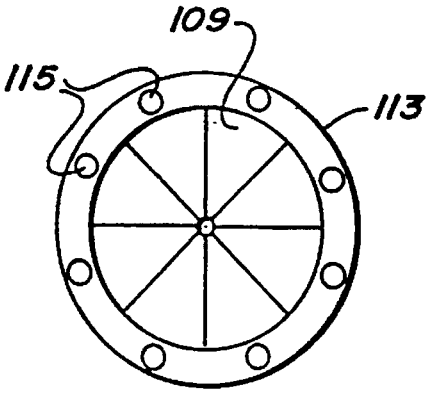
FIG. 25 is a plan view of the rain shield shown in FIG. 24 by itself.

FIG. 25 shows the rain shield 109 by itself and shows fastening openings in the outer lip.

Figure 26:
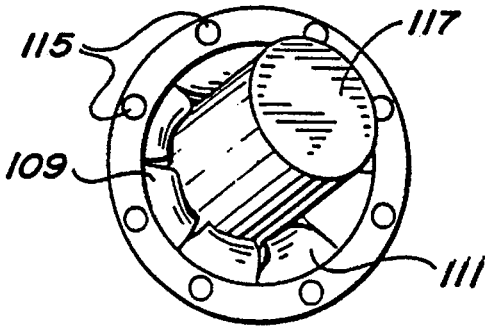
FIG. 26 is a plan view of the rain shield of FIG. 24 and 25 with a can just being inserted through such rain shield.

FIG. 26 shows the rain fastening with an empty soft drink can or the like 117 being inserted through the flexible triangular sections 111. Since an aesthetically desirable orifice through the lid includes a depression 119 around the orifice, it may be desirable to provide a short drain 121 shown in FIG. 24 in dotted lines from the side of the bottom of the depression to a position adjacent the outer edge of the receptacle to drain moisture collected upon the surface of the rain shield and draining to the side of the receptacle where it can be discharged from the side through the slats or otherwise outside the internal refuse recycling bags or other collectors. The drain may be in the form of a tubular conduit passing to or through the structural ring or may be free of the ring.

FIG. 27 shows a partially broken-away sectional view of a support ring 75 such as shown in FIG. 16, but where the slats 85, instead of being secured to the outside of the ring, which, as shown, is in the form of a "T" reclining on its side with a progressive slant or draft upon both the lower portion of the inside and the entire outside surface, are attached to the inside of the lower portion of the ring. This provides, it has been discovered, a progressive outward inclination of the plastic slats, which, when combined with attaching the slats 85 at the bottom of the receptacle upon or to the inside of either a reversed "T" section supporting ring or an L-shaped bottom ring such as shown in FIG. 28, will provide a strong durable receptacle with a pleasing, though preferably slight outward bow, similar to the bow in a conventional barrel, although much less, since the bow is provided not for strength or for ease in rolling, but only for providing a slight outward inclination to the sides which may be almost imperceptible, but has been found, nevertheless, to be attractive, at least subliminally, to observers as it breaks up what may otherwise provide a rather boxy appearance. The ring shown in FIG. 28 is identical to the ring 79 shown in FIG. 17, the only difference being that the slats 85 are attached to the inside rather than the outside.

Figure 30:
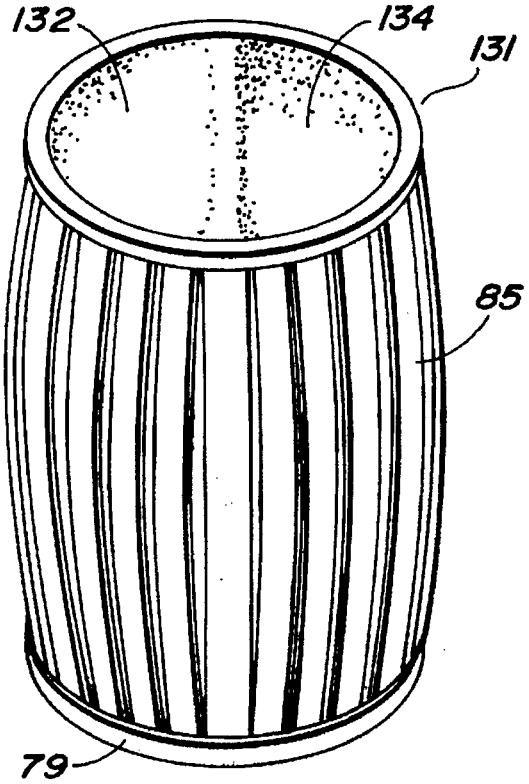
FIG. 30 is an isometric view of a further overall combination of a slatted exterior receptacle in accordance with the invention using the preferred structural rings of FIGS. 28 and 29 and showing a slight outward bow, or slight barrel shape, to the aspect of the receptacle.

FIG. 29 is a partially broken-away sectional view of slats 85 attached to the inside of an L-shaped support ring 131 at the top of a receptacle in accordance with the invention. The outward inclination of the surface 133 of the support ring 131 as in the other illustrations causes an outward bow in the surface of the receptacle as shown in FIG. 30 when combined with a similar ring at the bottom, as illustrated in FIG. 28. It may be seen in FIG. 30 how the slats have a slightly bowed out configuration.

Figure 31:
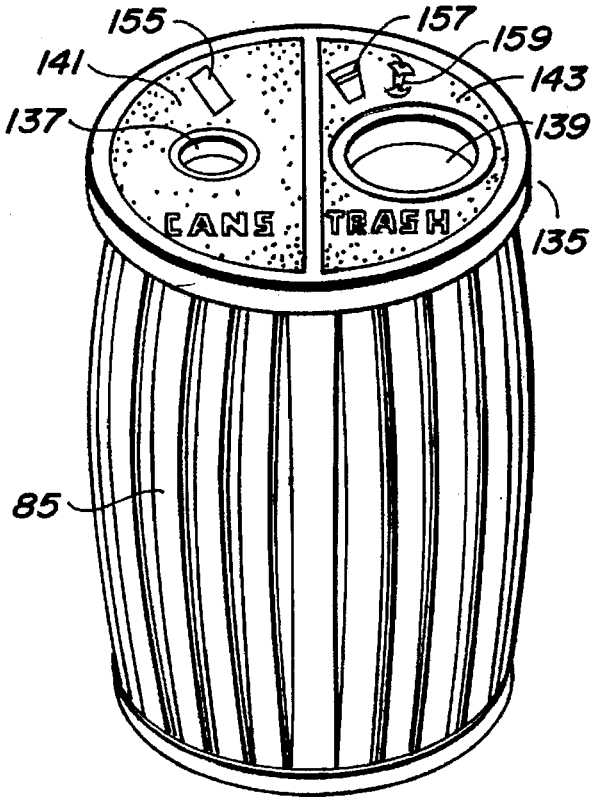
FIG. 31 is a view similar to that shown in FIG. 30 wherein a flat topped cap or lid has been placed over the top of the receptacle shown in FIG. 30, but further showing two separate orifices in said lid with the template-type use designation of the invention applied to the top of said lid to indicate the intended use of the two orifices.

FIG. 31 is a view similar to that shown in FIG. 30, but wherein a flat cap or lid 135 has been placed on top of the receptacle as shown in FIG. 30. Such flat lid 135 is an ordinary flanged lid such as, for example, a "hat box" lid, but is provided with two orifices in its surface 137 and 139 of which orifice 137 is smaller and intended for the receipt of cans for recycling, while the larger orifice 139 is intended for receipt of trash items. It will be understood that the two orifices lead into separate plastic or other receptacles, especially separate plastic bags, not shown in FIG. 31, but shown in FIG. 30 as bags 132 and 134 suspended from the inside of the upper ring by fastenings, not shown, such as the hooks shown in FIG. 19.

Upon the surface of the lid 135 is provided a designation or indication of the intended kinds of items that are to be inserted through the two orifices. Such designation takes the form of two contrastingly colored templates 141 and 143. The templates 141 and 143 take the form of two half moon shapes which are adhered to the surface of the lid in any suitable manner by a suitable weatherproof adhesive with preferably a space between such templates where the plastic or metal of the top itself shows through or is visible. The two templates 141 and 143 to be most effective should be some contrasting bright colors such as, for example, red and green, shown by different stippling in the figures, which colors are different from the color of the plastic top. The color of the plastic top, for example, is preferably a light neutral color such as white, tan or the like. The space 145 between the templates 141 and 143 provides a line of demarcation which emphasizes the difference between the two colored templates. Each template 141 and 143 has an opening or orifice 147 and 149 respectively in it which provides access to and surrounds the appropriate orifice in the lid. Above and below the orifices 147 and 149 on the lid surface are designations of the approved materials to be inserted through such orifices, namely in the case of orifice 147 surrounding the small can orifice 137 in the lid 135 there are cut out of the template below the orifice the word designation "CANS" 151 and under the orifice 149, the word or language designation or identification "TRASH" 153. Also above the orifices 147 and 149 there are preferably the pictorial designations respectively of a can 155 over orifice 147 and over the orifice 149 a pictorial designation of a used paper or plastic cup together with broken straw 157 and an apple core 159. Clearly any other pictorial designations could be used appropriate to the materials to be placed in the receptacle.

It has been found that use of the templates 141 and 143 is very effective in directing the proper materials into the proper orifices and plastic containers underneath. The adhered template is very durable and damage resistant, much more so that the provision of individual letters or pictures of the same designations, since the template has more bulk and provides a more continuous upper surface over which wear agents pass more easily without snagging and ripping or wearing individual designations off the surface. The designations thus being cut out of the template and being highlighted by the neutral color of the lid, such as white or the like, combined with the contrasting colors of the templates such as red and green or yellow and blue, plus preferably the use of a neutral line between the two half circles of the templates is very effective in providing an eye-catching instruction or designation means plus a very durable set of instructions or indications of use. The arrangement is many times more durable and probably at least twice as effective in catching the eye or interest of the user than similar painted instructions.

FIG. 32 is a plan view of a preferred lid of the invention similar to FIG. 22, but showing two orifices 161 and 163 in the top, one of which 161 is smaller than the other as in FIG. 31 in keeping with its intended use to receive soft drink cans or the like and surrounded, as in FIG. 31, with one of the same two contrasting color templates 141 and 143. These templates are heat molded or otherwise molded to the rounded surface and adhered to such surface by a suitable adhesive. It will be understood that various changes or variations could be used in the templates such as different designations in both wording and pictorial indications. However, the contrasting color templates would remain and preferably the two templates should also be separated by a neutral space to emphasize the separate nature or division between the materials to be placed within the two orifices. It is also preferable to have both written and pictorial directions as cutout portions of the two templates, but not absolutely necessary, and, of course, the designations of use of whatever form, can be placed upon the lids at any convenient and eye-catching location.

FIG. 33 is a plan view of a flat lid similar to that shown in FIG. 31 showing the lid with its template designations in an alternative form with different wording and no pictorial representations.

Figure 34:
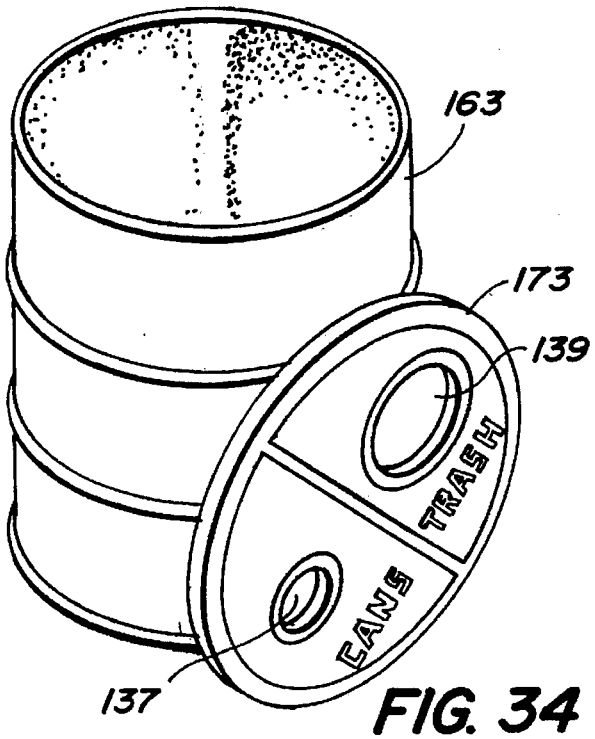
FIG. 34 is an isometric view of a lid incorporating a designation system using contrasting colored templates to distinguish between two orifices in the lid and showing such lid resting against an ordinary steel barrel or drum-type receptacle.

FIG. 34 is an isometric view of a flat lid with the template designations in accordance with the invention adapted for use with an ordinary metal trash barrel 163 having a support ring 165 for separate plastic containers 167 and 169 hooked over the edge and supporting two separate plastic bag-type receptacles under the two openings. The lid 171 with its template designations is shown resting beside the barrel 163 ready to be placed upon such barrel.

Figure 35:
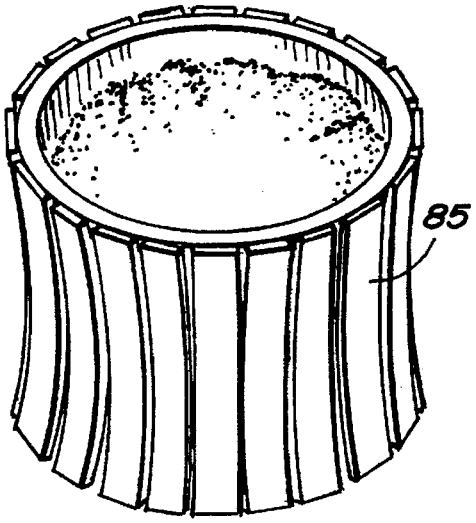
FIG. 35 is an isometric view of a relatively short receptacle made in accordance with the invention.

FIG. 35 is an isometric view of a relatively short receptacle made in accordance with the invention with internal supporting rings and having a slight inward bow of the slats 85 as a result of the inclined attachment surfaces of the internal rings to which the slats have been securely drawn. Such structure can be used as a planter for indoor or outdoor plants. Other than being short and not being supplied with a lid, the construction of the planter shown in FIG. 35 is essentially the same as shown in previous figures and can incorporate either a flat top or a slanted top as in the other constructions.

The templates shown in the various figures can be formed from any suitable plastic sheet material. Polyvinyl plastic has been found to be particularly suitable, but is by no means the only possible plastic material, any strong weatherproof and abrasion-resistant plastic sheet material being suitable. Usually the plastic sheets will be stamped into the proper shape and form with the proper legends to be used upon the surface of the multi-opening lids the openings of which the templates are to distinguish from each other.

From the above description and explanation in combination with the various figures, it will be understood that the present invention provides a great improvement in both the strength of a slatted-type slanted top receptacle and greater security against both scavenging and vandalism directed either at the contents of the receptacle or the receptacle itself. It will also be understood that in accordance with the invention, both inwardly bowed or slightly hourglass configured receptacles as well as outwardly bowed or slightly barrel configured receptacles can be formed from the combination of drafted or inclined walls of constructional rings and plastic slats drawn tightly to such rings depending upon the side of the rings to which the slats are drawn.

It will also be understood that the lids of receptacles made according to the invention as well as lids for other types of two or more orifice barrels may be made with a very desirable designation or marking system for the surface of the lids by the use of contrasting color plastic templates having preferably both English identifying legends and pictorial object identifications cut into the templates.

The locking means provides a convenient arrangement whereby authorized personnel may be granted access to the interior of the receptacle for emptying or for other purposes, whereas unauthorized persons will find it difficult to gain access. It will be understood that if desired, a stronger locking means could be provided. However, in most cases, the locking arrangement, including the flat metal pieces, will be adequate enough protection. In the case of a particularly determined vandal or scavenger, the metal pieces 51 and/or 55, which are merely screwed to their pedestals, may be bent, allowing such scavenger or vandal to remove the lid from the structural ring or the seat 35 in the structural ring 21. However, it is usually better to allow such removal of the top by a particularly determined or a powerful individual, whereupon the flat metal pieces may be easily replaced by unscrewing the bent pieces and replacing with new, flat pieces, rather than suffering possible structural damage to the actual receptacle. While no structural damage is likely to result to the lid itself, since it is a fairly heavy cast aluminum lid or to the structural rim, which is also fairly heavy, almost any locking arrangement can be forced with sufficient determination. Consequently, it is often better to accept ultimate forcing of the locking arrangement which can be easily repaired, rather than providing an ultimate locking arrangement which may allow so much force to be applied to the top of the receptacle that the fastenings securing the support ring 21 to the individual plastic slats 13 may be pulled away.

In the preferred arrangements of the invention with the outer slats bowed due to being tightly secured to the slightly inwardly inclined outer circumferences of the structural ring 75 or the slightly outwardly inclined inner circumferences of the same structural ring or similar structural rings and the provision of hooks within the receptacle secured to the lower portion or flange of the upper structural ring, as well as the provision of a rain shield in or contiguous with the upper orifice in the lid, a more pleasing appearance and additional convenience and efficiency of the receptacle is provided.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the prior art and therefore to effectively encompass the intended scope of the invention.

I claim:

1. A recycling and refuse receptacle comprising:

(a) a series of vertical slats of different lengths formed from a plastic resin composition arranged in substantially a side-by-side circular configuration providing a smoothly slanted top configuration of said receptacle, (b) at least one substantially horizontal ring positioned within the side-by-side circular configuration of the slats to which the slats are attached in a sequence providing said smoothly slanted top, (c) a rigid structural ring having an ovoid configuration with a smoothly curved outside inclination slanted or angled inwardly at a first position on the ring, slanted or angled outwardly at a second position substantially 180 degrees from the first position, arranged substantially vertically at positions 90 degrees to said first and second positions and angled at intermediate inclinations at intermediate positions, (d) said structural ring being secured to said slats at the upper end of the slats in an inclined orientation by fastening means traversing both the structural ring and the slats, and (e) a seat surface positioned upon a top surface of the structural ring, (f) a lid or cover means configured for receipt into the seat positioned upon the top surface of the structural ring, (g) said lid or cover having at least two orifices disposed in it for receipt of recyclables and refuse, and (h) an orifice use designation means upon the lid comprising at least two templates formed of thin durable plastic sheet material surrounding each of said orifices and having contrasting colors, each of the templates including a cutout portion providing a worded designation of the type of materials to be passed through the orifices into the receptacles and exposing an underlying surface of a contrasting color.

2. A recycling and refuse receptacle in accordance with claim 1 wherein the templates are half round sections of plastic of contrasting colors and have a vertical opening through which a neutral color of the top shows.

3. A recycling and refuse receptacle in accordance with claim 2 wherein the templates have both worded and pictorial designations in them.

4. A recycling and refuse receptacle in accordance with claim 3 wherein the contrasting color designation templates are formed from a polyvinyl plastic resin material.

5. A recycling and refuse receptacle comprising:

(a) a series of vertical slats formed from a plastic resin composition arranged in substantially a side-by-side circular configuration, (b) at least one substantially horizontal structural ring positioned against the lower ends of the slats to which the slats are attached, (c) a structural ring having a smoothly curved configuration positioned against the upper ends of the slats, (d) said structural rings being secured to said slats by fastening means traversing both the structural rings and the slats, (e) an outer surface of said lower and upper structural rings having a slight inclination at least over the portions attached to some of the slats with respect to the vertical axis of said receptacle, (f) such inclination on the lower and upper rings having similar components with respect to the vertical axis of the rings, and (g) the vertical slats being drawn tightly to the inclined outer surfaces of the structural rings such that the slats are provided with a slight bow with respect to vertical detectable to at least the careful observer.

6. A recycling and refuse receptacle in accordance with claim 5 wherein the inclination of the bow in the slats with respect to vertical is inwardly with respect to the receptacle.

7. A recycling and refuse receptacle in accordance with claim 5 wherein the inclination of the bow in the slats with respect to vertical is outwardly with respect to the receptacle.

8. A recycling and refuse receptacle in accordance with claim 7 wherein the structural ring positioned against the upper ends of the slats is arranged horizontally.

9. A recycling and refuse receptacle in accordance with claim 7 wherein the structural ring positioned against the upper ends of the slats is arranged itself at an inclination and additionally including a plurality of differentially lengthened slats forming a slanted top.

10. A recycling and refuse receptacle in accordance with claim 8 additionally comprising:

(h) a lid or cover means configured for receipt into the seat positioned upon the top surface of the structural ring, (i) said lid or cover having at least two orifices disposed in it for receipt of recyclables and refuse, and (j) an orifice use designation means upon the lid comprising at least two templates formed of thin durable plastic sheet material surrounding each of said orifices and having contrasting colors, each of the templates including a cutout portion providing a worded designation of the type of materials to be passed through the orifices into the receptacles and exposing an underlying surface of a contrast in color.

11. A recycling and refuse receptacle in accordance with claim 10 wherein the templates are half round sections of plastic of contrasting colors and have a vertical opening trough which a neutral color of the top shows.

12. A recycling and refuse receptacle in accordance with claim 11 wherein the templates have both worded and pictorial designations in them.

13. A recycling and refuse receptacle in accordance with claim 12 wherein the contrasting color designation templates are formed from a polyvinyl plastic resin material.

* * * * *